United States Patent [19]

Thompson

[11] 4,149,728

[45] Apr. 17, 1979

[54] POKER GAME USING A ROULETTE WHEEL

[76] Inventor: Richard G. Thompson, 1224 Curtin St., Houston, Tex. 77018

[21] Appl. No.: 831,741

[22] Filed: Sep. 9, 1977

[51] Int. Cl.[2] ..... A63F 3/00

[52] U.S. Cl. ..... 273/274; 273/142 E

[58] Field of Search ..... 273/274, 150, 142 E, 273/142 F

[56] References Cited

U.S. PATENT DOCUMENTS

| | | | |
|---|---|---|---|
| 1,445,891 | 2/1923 | Johnson | 273/274 |
| 2,176,110 | 10/1939 | Strash | 273/142 E |
| 2,394,866 | 2/1946 | McClune | 273/150 |
| 3,649,023 | 3/1972 | Schohn | 273/271 |
| 3,998,462 | 12/1976 | Goott | 273/274 |
| 4,043,560 | 8/1977 | Blackman | 273/236 |

*Primary Examiner*—Anton O. Oechsle
*Attorney, Agent, or Firm*—Daniel Jay Tick

[57] ABSTRACT

A poker game includes a roulette wheel mounted on a table top. The table top has a played card distribution area and a rack extending therefrom at an angle therewith for supporting a plurality of playing cards. Each card played is indicated in the played card distribution area. A wagering area on the table top indicates cards and poker hands for wagers concerning the operation of the roulette wheel.

4 Claims, 2 Drawing Figures

POKER GAME USING A ROULETTE WHEEL

BACKGROUND OF THE INVENTION

The present invention relates to a poker game. More particularly, the invention relates to a poker game using a roulette wheel.

The roulette wheel has 53 slots marked thereon representing the 52 cards in a poker card deck and a joker. A player decides whether he wishes to wager on a card, or group of cards or a particular poker hand and places appropriate chips on appropriate portions of the table top supporting the roulette wheel. A card rack mounted on the table top extends therefrom at an angle therewith for supporting a plurality of playing cards. A played card distribution area on the table top provides a plurality of spaces representing the playing cards of a poker deck and a joker for indicating cards selected by operation of the roulette wheel.

BRIEF SUMMARY OF THE INVENTION

In accordance with the invention, a poker game using a roulette wheel comprises a table having a table top. A roulette wheel is mounted on the table top and has a plurality of slots marked as the playing cards of a poker deck and a joker. A card rack is mounted on the table top and extends from the table top at an angle therewith for supporting a plurality of playing cards. A played card distribution area on the table top has a plurality of spaces representing the playing cards of a poker deck and a joker for indicating cards selected by operation of the roulette wheel. A wagering area on the table top indicates cards and poker hands for wagers concerning the operation of the roulette wheel.

Cards supported on the card rack are placed in the appropriate spaces of the played card distribution area after the cards are selected by operation of the roulette wheel. The wagering area comprises a first plurality of spaces representing ranges of card numbers and a second plurality of spaces representing poker hands. A selected one of the spaces of the second plurality of spaces represents a straight flush and selected others of the spaces of the second plurality of spaces represent the suits of the playing cards.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
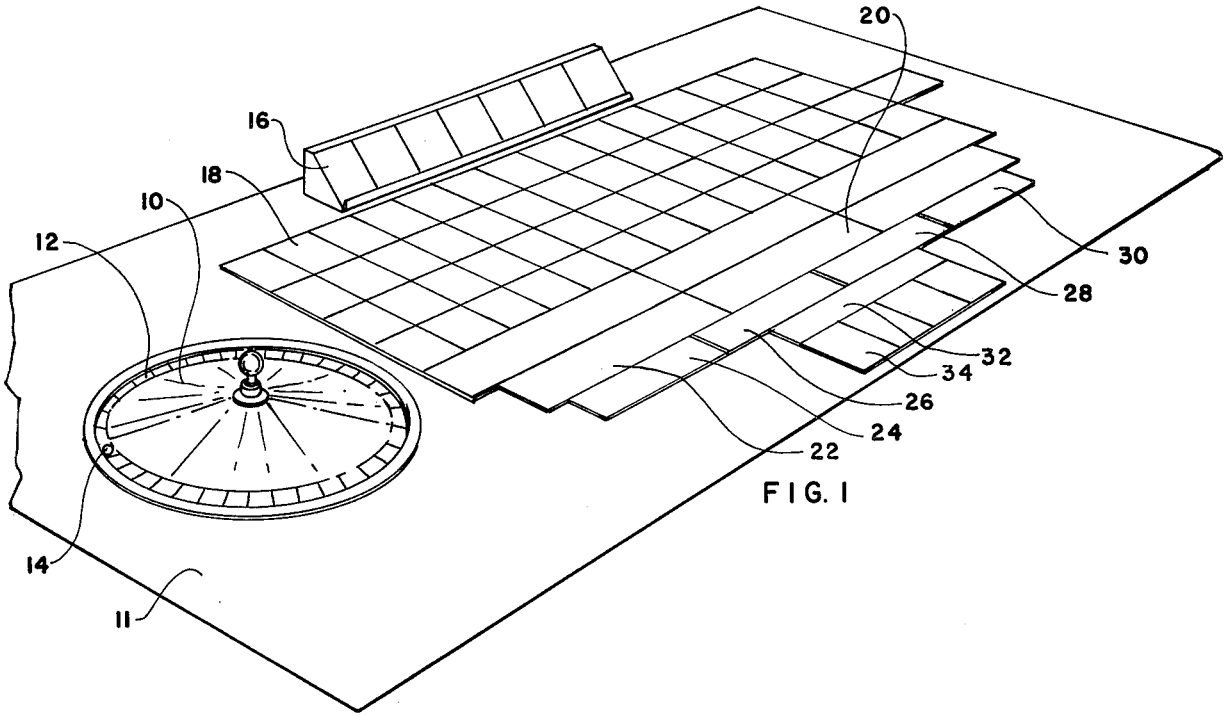
FIG. 1 is a perspective view of an embodiment of the poker game of the invention.
Figure 2:
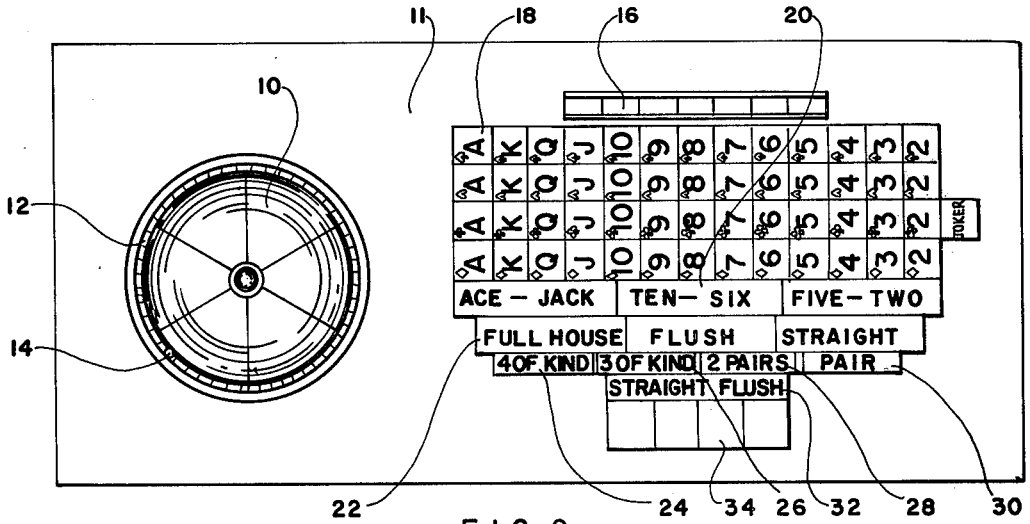
FIG. 2 is a top plan view, on a reduced scale, of the embodiment of FIG. 1.

The poker game of the invention uses a roulette wheel 10 (FIGS. 1 and 2) and comprises a table 11 having a table top shown in the FIGS. The roulette wheel 10 is mounted on the table top and has a plurality of slots 12 marked as the playing cards of a poker deck and a joker. The roulette wheel 10 has a roulette ball 14 (FIGS. 1 and 2).

A card rack 16 is mounted on the table top and extends from the table top at an angle therewith for supporting a plurality of playing cards.

A played card distribution area 18 is provided on the table top and has a plurality of spaces representing the playing cards of a poker deck and a joker for indicating cards selected by operation of the roulette wheel 10.

The card represented by the slot 12 of the roulette wheel 10 at which the roulette ball 14 comes to rest after the roulette wheel is spun or operated is removed from the cards supported on the card rack 16. The selected card is placed in the corresponding space of the played card distribution area 18.

A wagering area 20, 22, 24, 26, 28, 30, 32, 34 (FIGS. 1 and 2) on the table top indicates cards and poker hands for wagers concerning the operation of the roulette wheel 10. The wagering area comprises a first plurality of spaces 20 representing ranges of card numbers such as, for example, Aces to Jacks, Tens to Sixes and Fives to Twos (FIG. 2).

The wagering area also comprises a second plurality of spaces 22, 24, 26, 28, 30 and 32 representing poker hands such as Full House, a Flush, a Straight in spaces 22, Four of a Kind 24, Three of a Kind 26, Two Pairs 28, a Pair 30 and a Straight Flush 32, as shown in FIG. 2.

Selected others of the spaces 34 of the second plurality of spaces represent the suits of the playing cards, Hearts, Clubs, Diamonds and Spades.

A player decides what to wager on and places appropriate chips in the spaces of the wagering area 20, 22, 24, 26, 28, 30, 32, 34 representing his selected wager. The player may thus wager on a specific range of cards, represented by the spaces 20, or on any desired poker hand, represented by the spaces 22, 24, 26, 28, 30, 32. If the Player places a wager on a Straight Flush 32, he selects the suit of the Flush from the spaces 34.

What is claimed is:

1. A poker game using a roulette wheel, said poker game comprising a table having a table top;

a roulette wheel mounted on the table top and having a plurality of slots marked as the playing cards of a poker deck and a joker;

a card rack mounted on the table top and extending from said table top at an angle therewith for supporting a plurality of playing cards;

a played card distribution area on said table top having a plurality of spaces representing the playing cards of a poker deck and a joker for indicating cards selected by operation of the roulette wheel; and a wagering area on said table top indicating cards and poker hands for wagers concerning the operation of the roulette wheel.

2. A poker game as claimed in claim 1, wherein cards supported on the card rack are placed in the appropriate spaces of the played card distribution area after the cards are selected by operation of the roulette wheel.

3. A poker game as claimed in claim 1, wherein said wagering area comprises a first plurality of spaces representing ranges of card numbers and a second plurality of spaces representing poker hands.

4. A poker game as claimed in claim 3, wherein a selected one of the spaces of the second plurality if spaces represents a straight flush and selected others of the spaces of said second plurality of spaces represent the suits of the playing cards.

* * * * *